US006677006B2

(12) United States Patent
Otani et al.

(10) Patent No.: US 6,677,006 B2
(45) Date of Patent: Jan. 13, 2004

(54) INK-JET RECORDING MATERIAL

(75) Inventors: Teiichi Otani, Tokyo (JP); Atsushi Ono, Tokyo (JP); Noboru Kondo, Tokyo (JP); Hiroyuki Onishi, Nagano (JP); Shinya Yamagata, Nagano (JP); Masaya Shibatani, Nagano (JP); Jun Sugiyama, Nagano (JP)

(73) Assignees: Nippon Paper Industries Co., Ltd., Tokyo (JP); Seiko Epson Cororaton, Tokyo (JP)

( * ) Notice: Subject to any disclaimer, the term of this patent is extended or adjusted under 35 U.S.C. 154(b) by 90 days.

(21) Appl. No.: 09/907,631

(22) Filed: Jul. 19, 2001

(65) Prior Publication Data

US 2002/0034615 A1 Mar. 21, 2002

(51) Int. Cl.[7] ..... B41M 5/00

(52) U.S. Cl. ..... 428/32.25; 428/32.3; 428/32.34; 428/32.37

(58) Field of Search ..... 428/195, 206, 428/207, 331, 332, 341, 32.24, 32.25, 32.3, 32.34, 32.37

(56) References Cited

U.S. PATENT DOCUMENTS 5,888,367 A * 3/1999 Mouri et al. ..... 204/483
6,096,469 A * 8/2000 Anderson et al. ..... 430/119
6,326,323 B1 * 12/2001 Shimano et al. ..... 442/76
6,350,507 B1 * 2/2002 Iwamoto et al. ..... 428/195
6,410,123 B1 * 6/2002 Otani et al. ..... 428/212
6,436,513 B1 * 8/2002 Kitamura et al. ..... 428/195
6,492,005 B1 * 12/2002 Ohbayashi et al. ..... 428/195
2001/0036552 A1 * 11/2001 Otani et al. ..... 428/411.1

FOREIGN PATENT DOCUMENTS

EP 0903246 A 3/1999
EP 1008457 A 6/2000
EP 1016546 A 7/2000

* cited by examiner

*Primary Examiner*—Bruce H. Hess
*Assistant Examiner*—B. Shewareged
(74) *Attorney, Agent, or Firm*—Millen, White, Zelano Branigan, P.C.

(57) ABSTRACT

An ink-jet recording material having on a support at least an ink-receiving layer, with the ink-receiving layer being comprised of a light resistance-imparting layer as a lower layer and a coloration layer as an upper layer. Herein, the light resistance-imparting layer comprises a light-resistance imparting chemical constituted of 1 to 10 parts by weight of a benzotriazole compound as ultraviolet absorbent, 1 to 8 parts by weight of magnesium sulfate and 1 to 10 parts by weight of zinc oxide in combination with 100 parts by weight of an ink absorbing pigment, and besides, the coloration layer contains no light resistance-imparting chemicals.

11 Claims, No Drawings

INK-JET RECORDING MATERIAL

FIELD OF THE INVENTION

The present invention relates to a recording material for ink-jet printing process. In particular, the invention is concerned with an ink-jet recording material that can ensure very excellent light-resistant properties in images recorded therein and can provide images of excellent coloration quality when ink-jet printing in color is done thereon by the use of not only dye ink but also pigment ink.

BACKGROUND OF THE INVENTION

Ink-jet recording methods can easily achieve full-color recording and reduction of printing noises. In recent years, therefore, the utilization of ink-jet recording methods has been spreading at a rapid rate. According to such a method, fine drops of ink are jetted from nozzles at a high speed so as to direct toward a recording material, and a large quantity of solvent is contained in the ink used. As a result, recording materials for ink-jet recording are required to absorb ink promptly.

The recent years have also seen rapid proliferation of personal computers and digital cameras. Under these circumstances, printers as apparatus for outputting such digital image information have come to be required to produce images having qualities on a level similar to those attained by silver salt photography. Thus, it has also become necessary for ink-jet recording materials used in such printers to ensure colors of higher densities, higher resolution and more excellent color reproduction than usual in the images printed thereon.

On the other hand, the storage stability of recorded images has come to assume greater importance as significant improvements in image quality have been made. In the ink-jet process, acid dyes and direct dyes have been prevailingly used in printing ink, because they cause no clogging of a printing head and provide color images of high saturation. Under current circumstances, therefore, it is not always possible to choose dyes having satisfactory water resistance and light resistance For the purpose of ensuring both water resistance and light resistance for printed images, Tokkai Sho 59-198188 (the term "Tokkai" as used herein means an "unexamined published Japanese patent application) discloses the use of specified cationic resins, such as quaternary compounds of polyethylenimine, in the ink-receiving layer of an ink-jet recording material, Tokkai Sho 60-260377 discloses the use of cationic colloidal silica, Tokkai Sho 61-146591 discloses the use of hindered amine compounds, and Tokkai Sho 61-284478 discloses the use of quaternary ammonium salts of polyoxyalkylenated amine monocarboxylic acid esters.

However, the use of those compounds cannot impart sufficient light resistance to printed images, although it is certain that appreciable improvements in water resistance are observed. Such being the case, ink-jet recording materials successful in attaining compatibility between water resistance and light resistance have not been developed yet.

As to improvement of light resistance, it is disclosed to add an ultraviolet absorbent and an antioxidant to recording layers in Tokkai Sho 57-87988 and Tokkai sho 57-87989 respectively. Although the light resistance is improved for a certainty by addition of such agents, the improvement achieved is still insufficient from the practical point of view, and besides, the added agents create problems of printed image quality. More specifically, serious reduction in color densities of printed images is caused in the former case, so the printed images cannot have qualities comparable to those of photographs from the very beginning of a printing operation. In the latter case, on the other hand, the antioxidant itself turns brown with a lapse of time, so the keeping quality in white areas of recording paper becomes a problem.

As mentioned above, traditional arts cannot provide ink-jet recording materials capable of forming images comparable to photographic images in appearance and, what is more, retarding deterioration caused in image quality by exposure to light, water or gas, and being free of discoloration in the white areas, namely having high keeping quality.

More specifically, the addition of chemicals for improvement of keeping quality to a recording layer or the formation of a protective layer containing such chemicals on a recording layer in ordinary manners cannot bring about desirable results. After all, it is impracticable to form a protective layer outside the ink-receiving layer since the ink-jet recording process consists in forming images by directing a jet of ink at the recording layer surface. In addition, the coloring materials used for the ink are direct dyes and acid dyes. Although these dyes are superior in hue, they are liable to discolor or lose their colors through cleavage of the double bonds in the dye structures by ultraviolet rays or oxidative gases. In addition, they are susceptible to other chemical reagents also, and so the addition of chemical reagents to the coloration layer tends to produce negative effect directly on coloration.

As a result of intensive study to solve those difficulties, to our surprise, we have found that the addition of a light resistance-imparting chemical prepared by mixing 1 to 10 parts by weight of an ultraviolet absorbent of benzotriazole type, 1 to 8 parts by weight of magnesium sulfate and 1 to 10 parts by weight of zinc oxide to a layer arranged just under a coloration layer to receive ink directly can produce significant improvement in light resistance, and besides, can completely preclude negative influences of chemicals on coloration of dyes, which has so far been a problem in need of solution, thereby achieving the present invention.

SUMMARY OF THE INVENTION

Therefore, an object of the invention is to provide a recording material on which images having high color density, excellent color reproduction and photographic quality can be printed, particularly by means of a high-resolution ink-jet printer, and besides, the images printed have excellent light resistance and undergo no changes in hue upon storage.

The aforementioned object is attained with an ink-jet recording material having on a support at least an ink-receiving layer, characterized in that the ink-receiving layer is comprised of a light resistance-imparting layer as a lower layer and a coloration layer as an upper layer, the light resistance-imparting layer comprises 100 parts by weight of ink absorbing pigments, and a light resistance-imparting chemical constituted of 1 to 10 parts by weight of a benzotriazole ultraviolet absorbent, 1 to 8 parts by weight of magnesium sulfate and 1 to 10 parts by weight of zinc oxide, and the coloration layer is a layer free of light resistance-imparting chemicals.

Further, it has been ascertained that the present recording material ensured more excellent coloration than ever in images printed with pigment ink as well as dye ink.

DETAILED DESCRIPTION OF THE INVENTION

The major function of the present coloration layer consists in receiving ink and fixing dyes in ink to form ink images therein. The specific composition of this layer may be selected appropriately from those of hitherto known ink-receiving layers depending on the intended quality level of images; however, it is of primary importance to the invention to formulate the coloration layer so to be free of light resistance-imparting chemicals. As suitable examples of ingredients mainly constituting the coloration layer, mention may be made of a pigment having high oil absorption, that is, high ink receptivity, a binder for the pigment and a cationic high polymer capable of fixing dyes and enhancing water resistance. The coloration layer may be a single layer or a multiple layer.

The main function of the present light resistance-imparting layer consists in absorbing and fixing a vehicle of ink passing through the coloration layer. Therefore, it is appropriate that the light resistance-imparting layer be constituted mainly of a pigment having high oil absorption and a binder for the pigment, although the composition thereof should be selected depending on the kind of ink to be used and the recording speed to be set. The key feature of the invention is incorporation of light resistance-imparting chemicals into this light resistance-imparting layer as a lower layer of the coloration layer.

The light resistance-imparting chemicals may be incorporated through addition to a coating composition together with the pigment and the binder. In another way, a solution containing these chemicals as main components may be coated on a layer made up of the pigment and the binder, or the layer may be immersed in the solution. Further, the light resistance-imparting layer may be a single layer or a multiple layer.

In addition, a coating layer participating in ink absorption may be provided between the light resistance-imparting layer and the support.

The suitable coverage of each coating layer depends on the kind of ink used, the minuteness level of the intended images, the recording speed, the kinds and the formulation of ingredients constituting the layer.

With respect to the coloration layer, the suitable coverage is generally from 3 to 30 g/m$^2$, preferably from 4 to 15 g/m$^2$. Decrease in coverage of the coloration layer tends to cause degradation in ink absorption, while increase therein tends to adversely affect light resistance. As far as the coloration layer has its coverage in the aforementioned range, it can hold a relatively low concentration of ink-jet printing ink in an amount required for formation of photograph-like images, and besides, the effects of light resistance-imparting chemicals incorporated in the absorbing layer provided underneath the coloration layer can be achieved.

The suitable coverage of the light resistance-imparting layer, though it somewhat depends on the kind of base paper used, ranges roughly from 3 to 30 g/m$^2$, preferably from 4 to 20 g m$^2$. The light resistance-imparting layer having a low coverage tends to lower ink absorption and light resistance; while the light resistance-imparting layer having a high coverage tends to be weak in coating layer strength and have a disadvantage of high cost.

Further, it is advantageous that the total coverage of the coloration layer and the light resistance-imparting layer is from 6 to 30 g/m$^2$. When the coverage is less than 6 g/m$^2$, the ink-receiving layer as a whole causes a shortage of ink-absorbing capacity; as a result, a bleeding phenomenon may occur. When the total coverage is increased beyond 30 g/m$^2$, on the other hand, reduction in coating layer strength tends to be caused; as a result, the coatings are liable to come off in powder. In addition, such a great coverage causes a too large increase of ink absorption in the vertical direction; as a result, the diameter of ink dots becomes too small to completely fill up solid images, and the so-called banding phenomenon tends to occur.

The light resistance-imparting chemical used in the invention is a combination of zinc oxide as inorganic ultraviolet absorbent, a benzotriazole compound as organic ultraviolet absorbent and magnesium sulfate as a metal salt. On the other hand, titanium dioxide and cerium oxide well-known as inorganic ultraviolet absorbents are unsuitable for the present purpose, because these oxides sometimes do light resistance more harm than good when used in the present ink-receiving layer.

The amount of zinc oxide added is from 1 to 10 parts by weight, particularly preferably 2 to 8 parts by weight, per 100 parts by weight of ink-absorptive pigment. When zinc oxide is added in an amount smaller than 1 parts by weight, it cannot impart satisfactory light resistance; while, when the amount of zinc oxide added is greater than 10 parts by weight, the images formed take on a undesirable yellowish hue.

Further, ultraviolet absorbents of benzophenone and hindered amine types, which are well-known as organic ultraviolet absorbents, require addition in greater amounts because their contributions to light resistance-increasing effect are small. As a result, the production cost becomes high and their adverse influences on printed image quality, including ink absorption and coloration, come to be not negligible, so their use is not practical.

The amount of benzotriazole compound mixed as organic ultraviolet absorbent is from 1 to 10 parts by weight, preferably from 2 to 8 parts by weight, per 100 parts by weight of ink-absorptive pigments. When the benzotriazole compound as ultraviolet absorbent is used in an amount smaller than 1 parts by weight, the intended light resistance cannot be attained; while, when it is used in an amount greater than 10 parts by weight, it renders the coating layer opaque to degrade coloration of ink. The organic ultraviolet absorbent used in the invention may be any of benzotriazole compounds as far as they have at least one benzotriazole nucleus per molecule and ultraviolet absorbing properties. However, as suitable examples thereof, mention may be made of 2-(2'-hydroxy-5'-methylphenyl)benzotriazole, 2-(2'-hydroxy-5'-t-octylphenyl)benzotriazole, 2-(2'-hydroxy-3'-t-butyl-5'-methylphenyl)-5-chlorobenzotriazole, 2-(2-hydroxy-3', 5'-di-t-butylphenyl)-5-chlorobenzotriazole, 2-(2'-hydroxy-3', 5'-di-t-amylphenyl)benzotriazole and methylene-bis[2-(2'-hydroxy-5'-dodecanylphenyl) benzotriazole].

By mixing magnesium sulfate in the present light resistance-imparting layer, images formed in the present recording material can have more improved light resistance. In particular, the magnesium sulfate mixed can produce significant improvement in light resistance of a magenta image hitherto inferior to those of other color images. Although reasons why the light resistance of color images can be improved by magnesium sulfate are unclear yet, the light resistance improvement may be supposed to be due to stabilization of coloring materials in ink by magnesium sulfate. On the other hand, the use of water-soluble metal salts other than magnesium sulfate causes problems. For instance, the use of aluminum salts causes a bronze phenomenon, or reddish coloration of black image. In the case of using sodium salts, the effect produced is insufficient. When zinc salts are used, on the other hand, the images formed come to assume a yellowish tint with the lapse of time.

The amount of magnesium sulfate mixed is from 1 to 8 parts by weight, particularly preferably from 2 to 6 parts by weight, per 100 parts by weight of ink-absorptive pigments. When the amount of magnesium sulfate mixed is smaller than 1 parts by weight, satisfactory light resistance cannot be achieved. Therein, discoloration of magenta ink is serious in particular. When the amount of magnesium sulfate mixed is greater than 8 parts by weight, on the other hand, undesirable bronze phenomenon is observed.

The present recording material has no particular restrictions on a support used therein. Both transparent and opaque supports can be used therein. Examples thereof include various plastic films, such as films of cellophane, polyethylene, polypropylene, soft polyvinyl chloride, hard polyvinyl chloride and polyester, and a wide variety of paper, such as wood-free paper, base paper for photographic paper, drawing paper, painting paper, art paper, coated paper, cast-coated paper, craft paper, impregnated paper and synthetic paper. Depending on the desired purpose, the support for the present recording material can be selected properly from the plastic films or various paper sheets as recited above.

The pigment generally used in the present light resistance-imparting layer and coloration layer is synthetic amorphous silica, but other pigments may also be used. Examples of usable pigments include alumina, hydrated alumina (e.g., alumina sol, colloidal alumina and psuedo-boehmite), aluminum silicate, magnesium silicate, magnesium carbonate, precipitated calcium carbonate, ground calcium carbonate, kaolin, talc, calcium sulfate, zinc carbonate, calcium silicate and aluminum hydroxide, and plastic pigments.

For attaining the intended ink absorbency as the coverage is kept within a range that the coating layers don't come off in powder after drying, the pigments used are required to have an average oil absorption high to a certain extent. Specifically, it is advantageous for the pigments used to have their average oil absorption within the range of 100 to 300 ml/100 g.

The foregoing oil absorption expressed as an average indicates that, even when a mixture of two or more pigments having different oil absorption values is used, the mixture can serve for the purpose as far as the average of oil absorption values for all the pigments mixed is within the foregoing range. The light resistance-imparting layer and the coloration layer may be identical in species and amounts of pigments mixed, but it is advantageous that the average oil absorption of pigments used in the coloration layer is a little higher than that in the light resistance-imparting layer. Additionally, the oil absorption is determined by the method defined in JIS K5101. The binder used in the present light resistance-imparting layer and the coloration layer each can be selected appropriately from known binders, such as polyvinyl alcohol and modified products of polyvinyl alcohol, polyvinyl acetate, oxidized starch, etherified starch, casein, gelatin, soybean protein, carboxymethyl cellulose, SB latex, NB latex, acrylic resin latex, ethylene-vinyl acetate copolymer latex, polyurethane and unsaturated polyester resins. These binders may be used alone or as a mixture thereof. Although the suitable amount of binders used somewhat varies depending on pigments used in combination, the range thereof is limited. Specifically, the suitable amount of binders added is in the range of 5 to 60 parts by weight, preferably 10 to 40 parts by weight, per 100 parts by weight of pigments used in combination.

This is because, when the amount of binders used is smaller than 5 parts by weight, the coating layer is low in strength irrespective of species of pigments used, and so it tends to come off in powder and has a surface-strength problem. On the other hand, when the amount of binders used is increased beyond 60 parts by weight, the ink absorption of the resulting layer is degraded, and so bleeding or setoff problems tend to arise.

To the light resistance-imparting layer and the coloration layer according to the invention, various additives including a pigment-dispersing agent, a thickener, an antifoaming agent, a defoaming agent, a release agent, a blowing agent, a coloring dye, a coloring pigment, a fluorescent dye, an antiseptic, a waterproof agent, a surfactant and a wet paper strength increasing agent can be added in appropriate amounts, if needed.

For providing the present light resistance-imparting and coloration layers on a support, general coating apparatus of various kinds, such as a blade coater, a roll coater, an air knife coater, a bar coater, a gate roll coater, a curtain coater, a short dwell coater, a gravure coater, a flexo gravure coater and a size press, can be used under an on-machine or off-machine condition. In addition, a transfer method can also be adopted wherein the light resistance-imparting layer is coated on a support, the coloration layer is coated on a film, and then these coatings are brought into face-to-face contact and bonded together. Further, it is also possible to produce a high-gloss recording material by coating a coloration layer by means of a cast coater after providing the light resistance-imparting layer. Furthermore, surface treatment with a calendering apparatus, such as a machine calender, a super calender or a soft calender, may be carried out after providing the coloration layer. Of course, such surface treatment may be carried out at the stage of providing the light resistance-imparting layer, then a coloration layer is provided, and such surface treatment may be carried out once again.

The entire disclosure of all application, patents and publications, cited above and below, and of corresponding Japanese applications No. 2000-219159, filed Jul. 19, 2000 and No. 2001-216204, filed Jul. 17, 2001, are hereby incorporated by reference.

Now, the invention is illustrated in more detail by reference to the following examples. However, it should be understood that these examples are not to be construed as limiting the scope of the invention in any way. Unless otherwise noted in the following examples and comparative examples, all "parts" and all "%" are by weight and the term "coverage" is expressed as a dry weight (g) per $m^2$ of coating layer. Additionally, formulae of coating compositions prepared in Examples and Comparative Examples are set forth in Table 1, and the results obtained are shown in Table 2.

EXAMPLE 1

Base Paper:

Hardwood bleached kraft pulp in an amount of 95 parts and softwood bleached kraft pulp in an amount of 5 parts were mixed together, and beaten till the pulp mixture had a freeness of 450 ml (in terms of Canadian standard freeness). The resulting pulp was admixed with 2 parts of cationic starch, 0.1 parts of anionic polyacrylamide and 0.3 parts of an alkylketene dimer emulsion, and made into paper web by means of a Fourdrinier paper machine. In making the paper web, three-stage wet press was carried out first, and then two-stage tension press was carried out in the drying section, followed by drying. Thereafter, a solution containing 4% of oxidized starch and 0.5% of polyvinyl alcohol was coated on the paper web so as to have a coverage of 3.5 g/$m^2$ on a solids basis by means of a size press. The resulting paper web was dried, and further subjected to machine caledering treatment. The base paper thus made had a basis weight of 105 g/m$^2$.

Light Resistance-Imparting Layer (Lower Layer):

A coating composition was prepared by mixing 40 parts of synthetic amorphous silica having an oil absorption of 240 ml/100 g (FINESIL X-37B, trade name, a product of Tokuyama Corp.), 60 parts of synthetic amorphous silica having an oil absorption of 180 ml/100 g (Syloid 621, trade name, a product of Grace Davison Co., Ltd.), 30 parts of polyvinyl alcohol PVA 117 (trade name, a product of Kuraray Co., Ltd.), 4 parts of an ethylene-vinyl acetate copolymer emulsion, 4 parts of a styrene-butadiene latex, 8 parts of a dye fixer of polyamine type, 3 parts of magnesium sulfate, 3 parts of 2-(2'-hydroxy-5'-methylphenyl) benzotriazole (as a benzotriazole ultraviolet absorbent), 3 parts of zinc oxide, 0.3 parts of a defoaming agent (SN Defoamer, trade name, a product of San-nopco Co., Ltd.), 0.005 parts of a blueing agent, 0.5 parts of a fluorescent dye and dilution water in an amount required for adjusting a solids concentration to 20%. The coating composition thus prepared was coated on the base paper made in the foregoing manner by means of a blade coater so as to have a coverage of 10 g/m$^2$, and dried till the water content in the paper as a whole was reduced to 4.5%. Thus, paper with an undercoat was prepared.

Coloration layer (Upper Layer):

On the undercoat formed in the foregoing manner, a coating composition constituted of 80 parts of synthetic amorphous silica having an oil absorption of 240 ml/100 g (FINESIL X-60, trade name, a product of Tokuyama Corp.,), 20 parts of synthetic amorphous silica having an oil absorption of 240 ml/100 g (FINESIL X-37B, trade name, a product of Tokuyama Corp.), 33 parts of polyvinyl alcohol (PVA 117, trade name, a product of Kuraray Co., Ltd.), 5 parts of an ethylene-vinyl acetate copolymer emulsion, 8 parts of a dye fixer of polyamine type, 0.3 parts of a defoaming agent (SN Defoamer, trade name, a product of San-nopco Co., Ltd.), 0.01 parts of a blueing agent, 0.8 parts of a fluorescent dye and dilution water in an amount required for adjusting a solids concentration to 18% was coated with a blade coater so as to have a coverage of 8 g/m$^2$. And the layer thus coated was dried till the total water content in the recording paper obtained was reduced to 5%, and further subjected to soft calendering treatment under a linear pressure of 80 kg/cm. Thus, a coated paper for ink-jet recording was prepared.

EXAMPLE 2

An ink-jet recording paper was produced in the same manner as in Example 1, except that the coverage of the coating composition for a coloration layer (upper layer) was increased to 10 g/m$^2$.

EXAMPLE 3

An ink-jet recording paper was produced in the same manner as in Example 1, except that the amounts of magnesium sulfate and benzotrizole ultraviolet absorbent mixed in the coating composition for the light resistance-imparting layer (lower layer) were changed to 4 parts and 2 parts respectively, the resulting coating composition was coated at a coverage of 6 g/m$^2$, and the coverage of the coating composition for a coloration layer (upper layer) was increased to 15 g/m$^2$.

EXAMPLE 4

An ink-jet recording paper was produced in the same manner as in Example 1, except that the amounts of magnesium sulfate and benzotrizole ultraviolet absorbent mixed in the coating composition for the light resistance-imparting layer (lower layer) were changed to 2 parts and 4 parts respectively and the coverage of the coating composition for a coloration layer (upper layer) was increased to 15 g/m$^2$.

EXAMPLE 5

An ink-jet recording paper was produced in the same manner as in Example 1, except that the amounts of zinc oxide and benzotrizole ultraviolet absorbent mixed in the coating composition for the light resistance-imparting layer (lower layer) were changed to 7 parts and 8 parts respectively.

EXAMPLE 6

An ink-jet recording paper was produced in the same manner as in Example 1, except that the amounts of magnesium sulfate, zinc oxide and benzotrizole ultraviolet absorbent mixed in the coating composition for the light resistance-imparting layer (lower layer) were changed to 6 parts, 2 parts and 6 parts respectively.

EXAMPLE 7

An ink-jet recording paper was produced in the same manner as in Example 1, except that the amounts of magnesium sulfate and zinc oxide mixed in the coating composition for the light resistance-imparting layer (lower layer) were changed to 6 parts and 6 parts respectively

EXAMPLE 8

An ink-jet recording paper was produced in the same manner as in Example 1, except that the amounts of magnesium sulfate, zinc oxide and benzotrizole ultraviolet absorbent mixed in the coating composition for the light resistance-imparting layer (lower layer) were changed to 6 parts, 8 parts and 8 parts respectively.

EXAMPLE 9

An ink-jet recording paper was produced in the same manner as in Example 1, except that the amounts of magnesium sulfate, zinc oxide and benzotrizole ultraviolet absorbent mixed in the coating composition for the light resistance-imparting layer (lower layer) were changed to 1 parts, 1 parts and 1 parts respectively.

EXAMPLE 10

An ink-jet recording paper was produced in the same manner as in Example 1, except that the coverage of the coating composition for a coloration layer (upper layer) was increased to 25 g/m$^2$.

COMPARATIVE EXAMPLE 1

An ink-jet recording paper was produced in the same manner as in Example 1, except that the amount of magnesium sulfate mixed in the light resistance-imparting layer (lower layer) was increased to 5 parts and the other light resistance-imparting chemicals were not mixed.

COMPARATIVE EXAMPLE 2

An ink-jet recording paper was produced in the same manner as in Example 1, except that the amount of zinc oxide mixed in the light resistance-imparting layer (lower layer) was increased to 5 parts and the other light resistance-imparting chemicals were not mixed.

COMPARATIVE EXAMPLE 3

An ink-jet recording paper was produced in the same manner as in Example 1, except that the amount of benzotriazole ultraviolet absorbent mixed in the light resistance-imparting layer (lower layer) was increased to 5 parts and the other light resistance-imparting chemicals were not mixed

COMPARATIVE EXAMPLE 4

An ink-jet recording paper was produced in the same manner as in Example 1, except that the upper layer was formed using the coating composition for the lower layer in place of the coating composition for the upper layer, thereby imparting light resistance to both lower and upper layers.

COMPARATIVE EXAMPLE 5

An ink-jet recording paper was produced in the same manner as in Example 1, except that 4 parts of aluminum sulfate was mixed instead of 3 parts of magnesium sulfate in the coating composition for the light resistance-imparting layer (lower layer).

COMPARATIVE EXAMPLE 6

An ink-jet recording paper was produced in the same manner as in Comparative Example 5, except that 5 parts of titanium dioxide was mixed instead of 3 parts of zinc oxide in the coating composition for the light resistance-imparting layer (lower layer).

COMPARATIVE EXAMPLE 7

An ink-jet recording paper was produced in the same manner as in Example 1, except that the coating composition for the upper layer was used for forming the lower layer and the coating composition for the lower layer was used for forming the upper layer.

COMPARATIVE EXAMPLE 8

An ink-jet recording paper was produced in the same manner as in Comparative Example 5, except that benzophenone ultraviolet absorbent (UNINUL D-49, trade name, a product of BASF A.G.) was mixed instead of the benzotriazole ultraviolet absorbent in the light resistance-imparting layer (lower layer) and the amount thereof was changed to 5 parts.

COMPARATIVE EXAMPLE 9

An ink-jet recording paper was produced in the same manner as in Example 1, except that the amounts of magnesium sulfate, benzotrizole ultraviolet absorbent and zinc oxide mixed in the coating composition for the light resistance-imparting layer (lower layer) were increased to 10 parts, 12 parts and 13 parts respectively.

COMPARATIVE EXAMPLE 10

An ink-jet recording paper was produced in the same manner as in Example 1, except that no light resistance-imparting chemicals were mixed in the lower layer.

<Evaluation Methods>

Performance evaluations of recording materials prepared in the foregoing Examples and Comparative Examples were made using the following methods. Additionally, when rated as Δ or above on each evaluation item the recording materials can be used in practice without any particular problems.

In making evaluations, a commercial inkjet printer, Model PM-700C (trade name, a product of Seiko Epson Corp.), was used.

Coloration:

Black, cyan, magenta and yellow solid images formed with the aid of EXCEl (as a softwear of calculations for tabulation) were printed on each recording paper, and the density of each color image was measured with a reflection densitometer (Macbeth RD914). The coloration was evaluated by the sum total of measured values of those color densities.

◎: Sum total of measured values is 6 or above.

○: Sum total of measured values is at least 5 but below 6.

Δ: Sum total of measured values is at least 4 but below 5.

X: Sum total of measured values is below 4.

Ink Absorption:

The ink absorption was examined by printing, on each recording paper, a checkered pattern of red and green solid images formed with the aid of EXCEl, and carrying out visual observation of the extent of bleeding at the red-green boundary, and evaluated according to the following criteria.

◎: The boundary is clear and free of bleeding.

○: The boundary is a little unclear but no bleeding is observed at the boundary.

Δ: The boundary is unclear and bleeding is observed at the boundary.

X: The boundary is unclear and serious bleeding is observed at the boundary.

Bronze Luster:

Black solid images formed with the aid of EXCEL were printed on each recording paper, and observed visually at an angle of about 30 to 60 degrees. And the extent to which the images took on a bronze luster was evaluated according to the following criteria:

◎: No bronze luster is observed at all.

○: A little bronze luster is observed.

Δ: Bronze luster is observed on at least half of image areas.

X: Bronze luster is observed over almost all image areas.

Coming-off in Powder:

An A4-size sheet of each recording paper was cut 20 times along the width direction by means of a cutter, and the paper dust produced thereby was gathered and the weight thereof was measured. The tendency of the coatings to come off in powder was evaluated according to the following criteria:

: Paper dust gathered has a weight of below 5 mg

○: Paper dust gathered has a weight of from 5 mg to below 10 mg

Δ: Paper dust gathered has a weight of from 10 mg to below 30 mg

X: Paper dust gathered has a weight of 30 mg or above

Light resistance of printed images:

(i) Residual Density Rate

The black, cyan, magenta and yellow solid images formed with the aid of EXCEL were printed on each recording paper, and exposed to light for 25 hours by the use of a xenon weather meter. Therein, densities of each printed color image before and after the exposure were measured, and the residual density rate of each color image was calculated. The light resistance was evaluated by an average of the residual density rates of 4 color images. The criteria adopted therefor are as follows:

[Residual density rate (%)=Density of printed image after exposure ×100/Density thereof before exposure]

◎: The residual density rate is at least 80%.

○: The residual density rate is at least 60% but lower than 80%.

Δ: The residual density rate is at least 40% but lower than 60%.

X: The residual density rate is lower than 40%.

(ii) Hue of Image (ΔE)

Portrait images based on the Japanese Standards Association were subjected to RGB conversion by the use of "Photoshop" as an image processing software, and then printed on each recording paper in the superfine sheet mode of a printer, Model PM-700C. The printed images were each allowed to stand for one day, and then exposed to light for 25 hours by means of a xenon weather meter. Each image was examined for hues before and after the exposure (in the background gray area) by means of a calorimeter, and evaluated in terms of the ΔE value based on the L*a*b* color system. Additionally, the ΔE value of each printed image was determined according to JIS Z8730.

◎: ΔE is 2 or below.

○: ΔE is greater than 2 but not greater than 4.

Δ: ΔE is greater than 4 but smaller than 6.

X: ΔE is 6 or above.

TABLE 1

| | | Coverage | Metal salt | | Inorganic UV absorbent | | Type of Organic UV absorbent | |
|---|---|---|---|---|---|---|---|---|
| | | g/m$^2$ | species | parts | species | parts | species | parts |
| Example 1 | lower layer | 10 | Magnesium sulfate | 3 | Zinc oxide | 3 | Benzotriazole | 3 |
| | upper layer | 8 | Not mixed | — | Not mixed | — | Not mixed | — |
| Example 2 | lower layer | 10 | Magnesium sulfate | 3 | Zinc oxide | 3 | Benzotriazole | 3 |
| | upper layer | 10 | Not mixed | — | Not mixed | — | Not mixed | — |
| Example 3 | lower layer | 6 | Magnesium sulfate | 4 | Zinc oxide | 3 | Benzotriazole | 2 |
| | upper layer | 15 | Not mixed | — | Not mixed | — | Not mixed | — |
| Example 4 | lower layer | 10 | Magnesium sulfate | 2 | Zinc oxide | 3 | Benzotriazole | 4 |
| | upper layer | 15 | Not mixed | — | Not mixed | — | Not mixed | — |
| Example 5 | lower layer | 10 | Magnesium sulfate | 3 | Zinc oxide | 7 | Benzotriazole | 8 |
| | upper layer | 8 | Not mixed | — | Not mixed | — | Not mixed | — |
| Example 6 | lower layer | 10 | Magnesium sulfate | 6 | Zinc oxide | 2 | Benzotriazole | 6 |
| | upper layer | 8 | Not mixed | — | Not mixed | — | Not mixed | — |
| Example 7 | lower layer | 10 | Magnesium sulfate | 6 | Zinc oxide | 6 | Benzotriazole | 3 |
| | upper layer | 8 | Not mixed | — | Not mixed | — | Not mixed | — |
| Example 8 | lower layer | 10 | Magnesium sulfate | 6 | Zinc oxide | 8 | Benzotriazole | 8 |
| | upper layer | 8 | Not mixed | — | Not mixed | — | Not mixed | — |
| Example 9 | lower layer | 10 | Magnesium sulfate | 1 | Zinc oxide | 1 | Benzotriazole | 1 |
| | upper layer | 8 | Not mixed | — | Not mixed | — | Not mixed | — |
| Example 10 | lower layer | 10 | Magnesium sulfate | 3 | Zinc oxide | 3 | Benzotriazole | 3 |
| | upper layer | 25 | Not mixed | — | Not mixed | — | Not mixed | — |
| Compar. | lower layer | 10 | Magnesium sulfate | 5 | Not added | — | Not added | — |
| Example 1 | upper layer | 8 | Not added | — | Not added | — | Not added | — |
| Compar. | lower layer | 10 | Not added | — | Zinc oxide | 5 | Not added | — |
| Example 2 | upper layer | 8 | Not added | — | Not added | — | Not added | — |
| Compar. | lower layer | 10 | Not added | — | Not added | — | Benzotriazole | 5 |
| Example 3 | upper layer | 8 | Not added | — | Not added | — | Not added | — |
| Compar. | lower layer | 10 | Magnesium sulfate | 3 | Zinc oxide | 3 | Benzotriazole | 3 |
| Example 4 | upper layer | 8 | Magnesium sulfate | 3 | Zinc oxide | 3 | Benzotriazole | 3 |
| Compar. | lower layer | 10 | Aluminum sulfate | 4 | Zinc oxide | 3 | Benzotriazole | 3 |
| Example 5 | upper layer | 8 | Not added | — | Not added | — | Not added | — |
| Compar. | lower layer | 10 | Aluminum sulfate | 4 | Titanium | 5 | Benzotriazole | 3 |
| Example 6 | upper layer | 8 | Not added | — | dioxide | — | Not added | — |
| | | | | | Not added | | | |
| Compar. | lower layer | 10 | Not added | — | Not added | — | Not added | — |
| Example 7 | upper layer | 8 | Magnesium sulfate | 3 | Zinc oxide | 3 | Benzotriazole | 3 |
| Compar. | lower layer | 10 | Aluminum sulfate | 4 | Zinc oxide | 3 | Benzophenone | 5 |
| Example 8 | upper layer | 8 | Not added | — | Not added | — | Not added | — |
| Compar. | lower layer | 10 | Magnesium sulfate | 10 | Zinc oxide | 13 | Benzotriazole | 12 |
| Example 9 | upper layer | 8 | Not added | — | Not added | — | Not added | — |
| Compar. | lower layer | 10 | Not added | — | Not added | — | Not added | — |
| Example 10 | upper layer | 8 | Not added | — | Not added | — | Not added | — |

TABLE 2

| | | | | | Light resistance | |
|---|---|---|---|---|---|---|
| | Coloration | Ink absorption | Bronze luster | Coming-off in powder | Residual density rate | ΔE |
| Example 1 | ◎ | ○ | ◎ | ◎ | ◎ | ◎ |
| Example 2 | ◎ | ◎ | ◎ | ◎ | ◎ | ◎ |
| Example 3 | ◎ | ◎ | ◎ | ○ | ◎ | ◎ |
| Example 4 | ○ | ◎ | ◎ | ○ | ◎ | ◎ |
| Example 5 | ○ | ○ | ◎ | ◎ | ◎ | ◎ |
| Example 6 | ○ | ○ | ○ | ◎ | ◎ | ◎ |

TABLE 2-continued

| | Coloration | Ink absorption | Bronze luster | Coming-off in powder | Light resistance: Residual density rate | Light resistance: ΔE |
|---|---|---|---|---|---|---|
| Example 7 | ◎ | ○ | ○ | ◎ | ◎ | ◎ |
| Example 8 | ○ | ○ | ○ | ◎ | ◎ | ◎ |
| Example 9 | ◎ | ◎ | ◎ | ◎ | ○ | ○ |
| Example 10 | Δ | ◎ | ◎ | Δ | Δ | Δ |
| Compar. Ex. 1 | ◎ | ○ | ◎ | ◎ | X | X |
| Compar. Ex. 2 | ◎ | ○ | ◎ | ◎ | X | X |
| Compar. Ex. 3 | ◎ | ○ | ◎ | ◎ | X | X |
| Compar. Ex. 4 | X | X | X | Δ | ○ | ○ |
| Compar. Ex. 5 | ○ | ○ | X | ◎ | Δ | Δ |
| Compar. Ex. 6 | Δ | ○ | X | ◎ | Δ | X |
| Compar. Ex. 7 | X | X | X | Δ | ○ | ○ |
| Compar. Ex. 8 | X | Δ | X | ○ | Δ | Δ |
| Compar. Ex. 9 | X | Δ | X | ○ | ○ | Δ |
| Compar. Ex. 10 | ◎ | ○ | ◎ | ◎ | X | X |

As can be seen from Table 2, the ink-jet recording materials according to the invention were free of bronze luster and a defect that their coatings came off in powder, and besides, they had sufficient ink absorption and ensured excellent coloration and very high light resistance, especially with respect to hue, in the images recorded therein.

What is claimed is:

1. An ink-jet recording material comprising:

a support and at least an ink-receiving layer on said support, said ink-receiving layer being comprised of a light resistance-imparting layer as a lower layer and a coloration layer as an upper layer, wherein the light resistance-imparting layer comprises 100 parts by weight of ink-absorptive pigments and a light resistance-imparting chemical constituted of 1 to 10 parts by weight of a benzotriazole ultraviolet absorbent, 1 to 8 parts by weight of magnesium sulfate and 1 to 10 parts by weight of zinc oxide, and the coloration layer is a layer free of light resistance-imparting chemicals, wherein said coloration layer comprises an ink-absorptive pigment, a binder, and a cationic polymer, and wherein the ink-absorptive pigment in the coloration layer has an average oil absorption of 100–300 ml/100g.

2. An ink-jet recording material according to claim 1, wherein the coloration layer has a coverage of 3 to 30 g/m$^2$ and the light resistance- mparting layer has a coverage of 3 to 30 g/m$^{2.}$

3. An ink-jet recording material according to claim 2, wherein a combination of the coloration layer and the light resistance-imparting layer has a coverage of at most 30 g/m$^{2.}$

4. An ink-jet recording material according to claim 2, wherein the coloration layer has a coverage of 4 to 15 g/m$^{2.}$

5. An ink-jet recording material according to claim 2, wherein the light resistance-imparting layer has a coverage of 4 to 20 g/m$^{2.}$

6. An ink-jet recording material according to claim 1, wherein said benzotriazole ultraviolet absorbent is 2-(2'-hydroxy-5'-methyphenyl) benzotriazole, 2-(2'-hydroxy-5'-t-octylphenyl) benzotriazole, 2-(2'-hydro -3'-t-butyl-5'-methylphenyl)-5-chlorobenzotriazole, 2-(2'-hydroxy-3', 5'-di-t-butylphenyl -5-chlorobenzotriazole, 2-(2'-hydroxy-3', 5'-di-t-amylphenyl) benzotriazole or methylene-bis[2-(2'-hydroxy-5'-dodecanylphenyl) benzotriazole].

7. An ink-jet recording material according to claim 1, wherein the light resistance-imparting layer contains 2–6 parts by weight of magnesium sulfate per 100 parts by weight of ink-absorptive pigments.

8. An ink-jet recording material according to claim 1, wherein said ink-absorptive pigments of said light resistance-imparting layer are selected from alumina, hydrated alumina, alumina sol, colloidal alumina, psuedo-boehmite, aluminum silicate, magnesium silicate, magnesium carbonate, precipitated calcium carbonate, ground calcium carbonate, kaolin, talc, calcium sulfate, zinc carbonate, calcium silicate, aluminum hydroxide, plastic pigments, and synthetic amorphous silica.

9. An ink-jet recording material according to claim 1, wherein said light resistance-imparting layer contains binder (s) in an amount of 5–60 parts by weight per 100 parts by weight of ink-absorptive pigments.

10. An ink-jet recording material according to claim 1, wherein the coloration layer has a coverage of 3 to 30 g/m$^2$ and the light resistance-imparting layer has a coverage of 3 to 30 g/m$^2$, said benzotriazole ultraviolet absorbent is 2-(2'-hydroxy-5'-methylphenyl) benzotriazole, 2-(2'-hydroxy-5'-t-octylphenyl) benzotriazole, 2-(2'-hydroxy-3'-t-butyl-5'-methylphenyl)-5-chlorobenzotriazole, 2-(2'-hydroxy-3', 5'-di-t-butylphenyl)-5-chlorobenzotriazOle, 2-(2'-hydroxy-3', 5'-di-t-amylphenyl) benzotriazole or methylene-bis[2- (2'-hydroxy-5'-dodecanylphenyl) benzotriazole], the light resistance-imparting layer contains 2–6 parts by weight of magnesium sulfate per 100 parts by weight of ink-absorptive pigments, said ink-absorptive pigments of said light resistance-imparting layer are selected from alumina, hydrated alumina, alumina sol, colloidal alumina, psuedo-boehmite, aluminum silicate, magnesium silicate, magnesium carbonate, precipitated calcium carbonate, ground calcium carbonate, kaolin, talc, calcium sulfate, zinc carbonate, calcium silicate, aluminum hydroxide, plastic pigments, and synthetic amorphous silica, and said light resistance-imparting layer contains binder(s) in an amount of 5–60 parts by weight per 100 parts by weight of ink-absorptive pigments.

11. An ink-jet recording material according to claim 1, wherein the coloration layer has a coverage of 3 to 30 g/m$^2$ and the light resistance-imparting layer has a coverage of 3 to 30 g/m$^2$, said benzotriazole ultraviolet absorbent is 2-(2'-hydroxy-5'-methyiphenyl) benzotriazole, 2-(2'-hydroxy-5'-t-octyiphenyl) benzotriazole, 2-(2'-hydroxy-3'-t-butyl-5'-methylphenyl)-5-chlorobenzotriazole, 2-(2'-hydroxy-3', 5'-di-t-butylphenyl)-5-chlorobenzotriazole, 2-(2'-hydroxy-3', 5'-di-t-amylphenyl) benzotriazole or methylene-bis[2- (2'-hydroxy-5'-dodecanylphenyl) benzotriazole], the light resistance-imparting layer contains 2–6 parts by weight of magnesium sulfate per 100 parts by weight of ink-absorptive pigments, and said ink-absorptive pigments of said light resistance-imparting layer are selected from alumina, hydrated alumina, alumina sol, colloidal alumina, psuedo-boehmite, aluminum silicate, magnesium silicate, magnesium carbonate, precipitated calcium carbonate, ground calcium carbonate, kaolin, talc, calcium sulfate, zinc carbonate, calcium silicate, aluminum hydroxide, plastic pigments, and synthetic amorphous silica.

* * * * *

UNITED STATES PATENT AND TRADEMARK OFFICE

CERTIFICATE OF CORRECTION

PATENT NO. : 6,677,006 B2
DATED : January 13, 2004
INVENTOR(S) : Teiichi Otani et al.

It is certified that error appears in the above-identified patent and that said Letters Patent is hereby corrected as shown below:

Title page,
Between items [22] and [65], please insert the following:
-- [30] Foreign Application Priority Data
July 19, 2000, (JP) Japan 2000-219159
July 17, 2001, (JP) Japan 2001-216204 --

Signed and Sealed this

Twenty-fourth Day of August, 2004

JON W. DUDAS
*Director of the United States Patent and Trademark Office*